US007735422B2

(12) United States Patent
Riess et al.

(10) Patent No.: US 7,735,422 B2
(45) Date of Patent: Jun. 15, 2010

(54) SHOTGUN-BARREL PROJECTILE WITH INTERCALATION AND CARTRIDGE

(75) Inventors: Heinz Riess, Fürth (DE); Erich Muskat, Roth (DE)

(73) Assignee: Ruag Ammotec GmbH, Furth (DE)

( * ) Notice: Subject to any disclaimer, the term of this patent is extended or adjusted under 35 U.S.C. 154(b) by 133 days.

(21) Appl. No.: 10/575,241

(22) PCT Filed: Oct. 6, 2004

(86) PCT No.: PCT/EP2004/011138

§ 371 (c)(1),
(2), (4) Date: Jan. 9, 2007

(87) PCT Pub. No.: WO2005/038387

PCT Pub. Date: Apr. 28, 2005

(65) Prior Publication Data

US 2008/0047457 A1 Feb. 28, 2008

(30) Foreign Application Priority Data

Oct. 11, 2003 (DE) ..... 103 47 369

(51) Int. Cl.
*F42B 30/02* (2006.01)

(52) U.S. Cl. ..... 102/439

(58) Field of Classification Search ..... 102/430, 102/439, 448, 501, 517–19, 524; 244/3.23
See application file for complete search history.

(56) References Cited

U.S. PATENT DOCUMENTS

| | | | | | |
|---|---|---|---|---|---|
| 34,493 | A | * | 2/1862 | Havens | 102/525 |
| 40,153 | A | * | 10/1863 | Billings | 102/525 |
| 43,615 | A | * | 7/1864 | Williiams | 102/525 |
| 2,414,863 | A | * | 1/1947 | Foster | 102/517 |
| 3,058,420 | A | * | 10/1962 | Tanner et al. | 102/439 |
| 4,034,267 | A | | 7/1977 | Wilson | |
| 4,109,582 | A | * | 8/1978 | Haep et al. | 102/526 |
| 4,301,733 | A | * | 11/1981 | Arciniega Blanco | 102/517 |
| 4,538,520 | A | * | 9/1985 | Schmitz | 102/439 |
| 4,587,905 | A | * | 5/1986 | Maki | 102/430 |
| 4,779,535 | A | * | 10/1988 | Maki | 102/501 |
| 4,913,056 | A | * | 4/1990 | Matysik et al. | 102/439 |
| 4,958,570 | A | * | 9/1990 | Harris | 102/517 |
| 4,977,834 | A | | 12/1990 | Denis | |

FOREIGN PATENT DOCUMENTS

| | | | |
|---|---|---|---|
| BE | 866 822 | | 11/1978 |
| BE | 866822 | * | 11/1978 |
| DE | 38 15 738 A1 | | 11/1989 |
| SU | 1141293 A | | 2/1985 |

* cited by examiner

*Primary Examiner*—Michael Carone
*Assistant Examiner*—Reginald Tillman, Jr.
(74) *Attorney, Agent, or Firm*—Antonelli, Terry, Stout & Kraus, LLP.

(57) ABSTRACT

The invention relates to a ball cartridge (1) for a shotgun with an intermediate means (2) which can be built into a cartridge (20). The bullet (1) has a cylindrical free area (10) on the lower side thereof and the intermediate means (2) is embodied as a piston (21) on the end thereof facing the bullet (1) and the diameter thereof is adapted to the free area (10). In order to provide a solid link between the bullet (1) and the intermediate means (2), the bullet (1) is placed on the piston (21) or vice-versa and is pushed into the free area (10) and wedged during the piston (21) shot.

16 Claims, 4 Drawing Sheets

SHOTGUN-BARREL PROJECTILE WITH INTERCALATION AND CARTRIDGE

BACKGROUND OF THE INVENTION

The invention relates to a shotgun-barrel projectile with an intercalation for fitting into a cartridge, the projectile exhibiting a cylindrical free space on its underside, the intercalation taking the form of a plunger at its end facing towards the projectile, and the plunger having a diameter adapted to the free space.

A shotgun-barrel projectile of such a type is known from DE 38 15 738 C2.

SUMMARY OF THE INVENTION

The object underlying the invention consists in obtaining a connection, which is firm under all circumstances, of the projectile to the intercalation after discharge of the shot, the projectile being connected to the intercalation only loosely or not at all prior to discharge of the shot.

According to the invention, this is obtained by the projectile being mounted onto the plunger, or conversely, and by the plunger being pushed into the free space and wedged in the course of firing. With respect to this insertion and wedging it may also be said that the plunger is shot firmly into the projectile.

A preferred embodiment according to the invention is distinguished in that:

- the free space exhibits a projectile spigot arranged on the axis of symmetry,
- the plunger exhibits a bore arranged on the axis of symmetry,
- the projectile spigot and the bore are substantially adapted to one another in diameter, and
- the projectile spigot and the bore are endowed with wedging elements which in the course of firing and insertion of the plunger into the free space bring about a wedging of the plunger and therefore of the intercalation with the projectile.

In one configuration according to the invention, the wedging elements include a hollow cylindrical design of the end of the projectile spigot facing towards the intercalation, the underside of the projectile spigot exhibiting an inwardly inclined bevel, and the bore in the plunger exhibiting a hemisphere arranged at the bottom, and, in addition, a diameter reduction being arranged on the wall of the bore above the hemisphere.

In advantageous manner, a ring is connected to the plunger on the outer periphery of the plunger via a predetermined breaking-point. The ring is preferably formed in one piece with the plunger.

In a preferred embodiment, the ring constitutes a stop for the base of the projectile—i.e. the projectile is mounted onto the plunger and rests with its base on the ring.

In another configuration according to the invention, the ring is L-shaped and with one shank encompasses the projectile almost as far as the nose of the projectile. By virtue of this measure, the abrasion of the projectile in the barrel is minimised, since the projectile comes into contact with the barrel only in the upper region.

Another configuration of the invention provides that the one shank exhibits an inward-facing projection which engages a corresponding recess in the projectile, or conversely.

In order that the projectile remains in the cartridge case shortly after being fired, and in order that the intercalation—or, to be more precise, the plunger—is able to be pushed into the projectile, it is proposed that the nose of the projectile merges, via a bevel with adjoining shoulder running parallel to the axis of symmetry, with a plane face running perpendicular to the axis of symmetry and extending as far as the outer periphery of the projectile. The cartridge case which has been retracted by 180° rests upon this plane face.

The intercalation preferably consists of a plastic material, and the projectile preferably consists of a readily deformable material, in particular lead.

A cartridge according to the invention with a cartridge case and with a propelling charge is distinguished in that a shotgun-barrel projectile according to the invention with an intercalation is mounted on the propelling charge.

In an advantageous manner, the upper end of the cartridge case is retracted inwards by 180° and rests upon the plane face.

BRIEF DESCRIPTION OF DRAWINGS

The invention will be elucidated in more detail in the following on the basis of Figures.

DETAILED DESCRIPTION OF THE INVENTION

Figure 2:
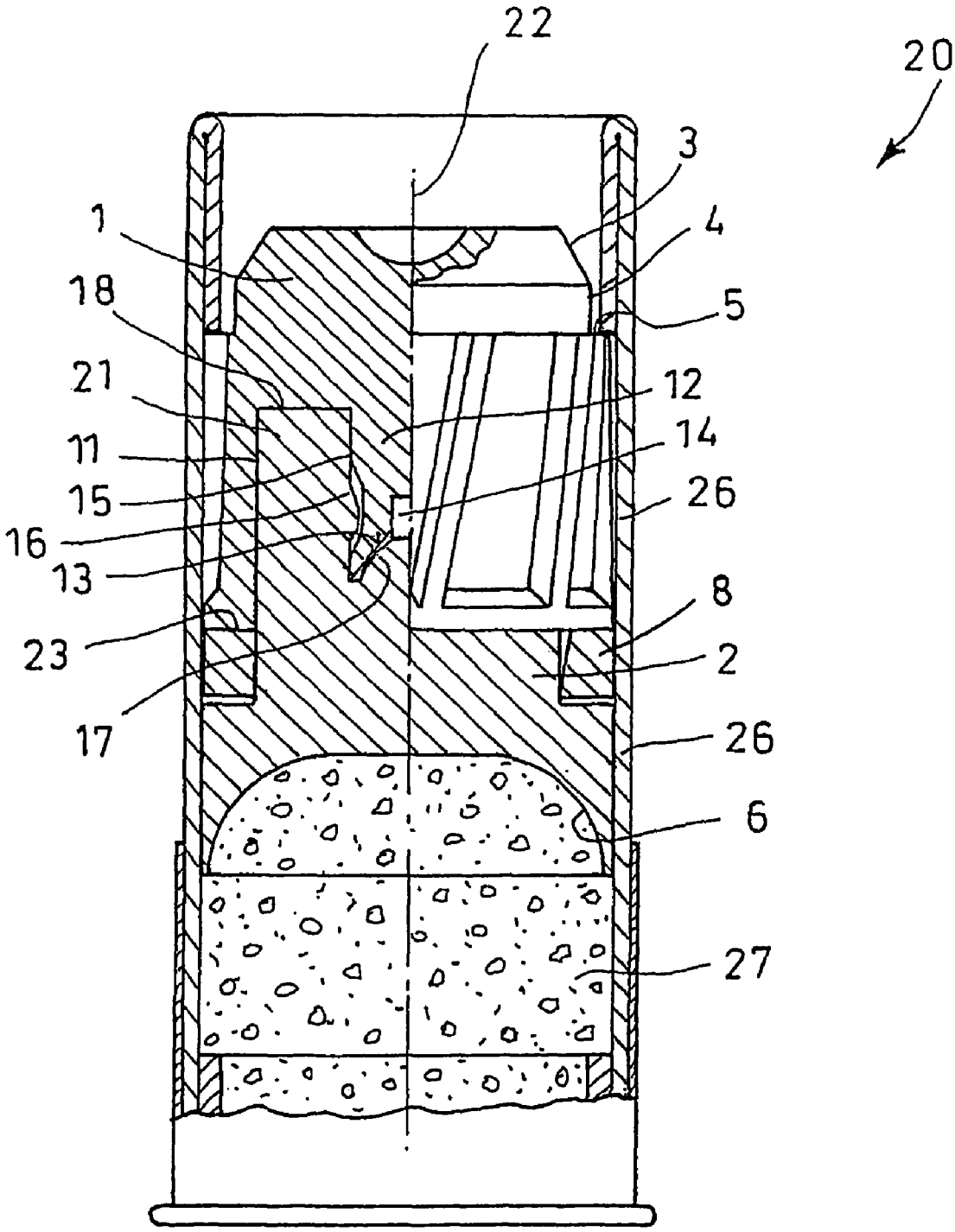
FIG. 2 shows this cartridge 20 shortly after the detonation of the propelling charge 27 before the projectile 1 has left the cartridge 20. The upper part of the intercalation 2, taking the form of a plunger 21, has been pushed into the projectile 1 and is also wedged there (see description below).
Figure 3:
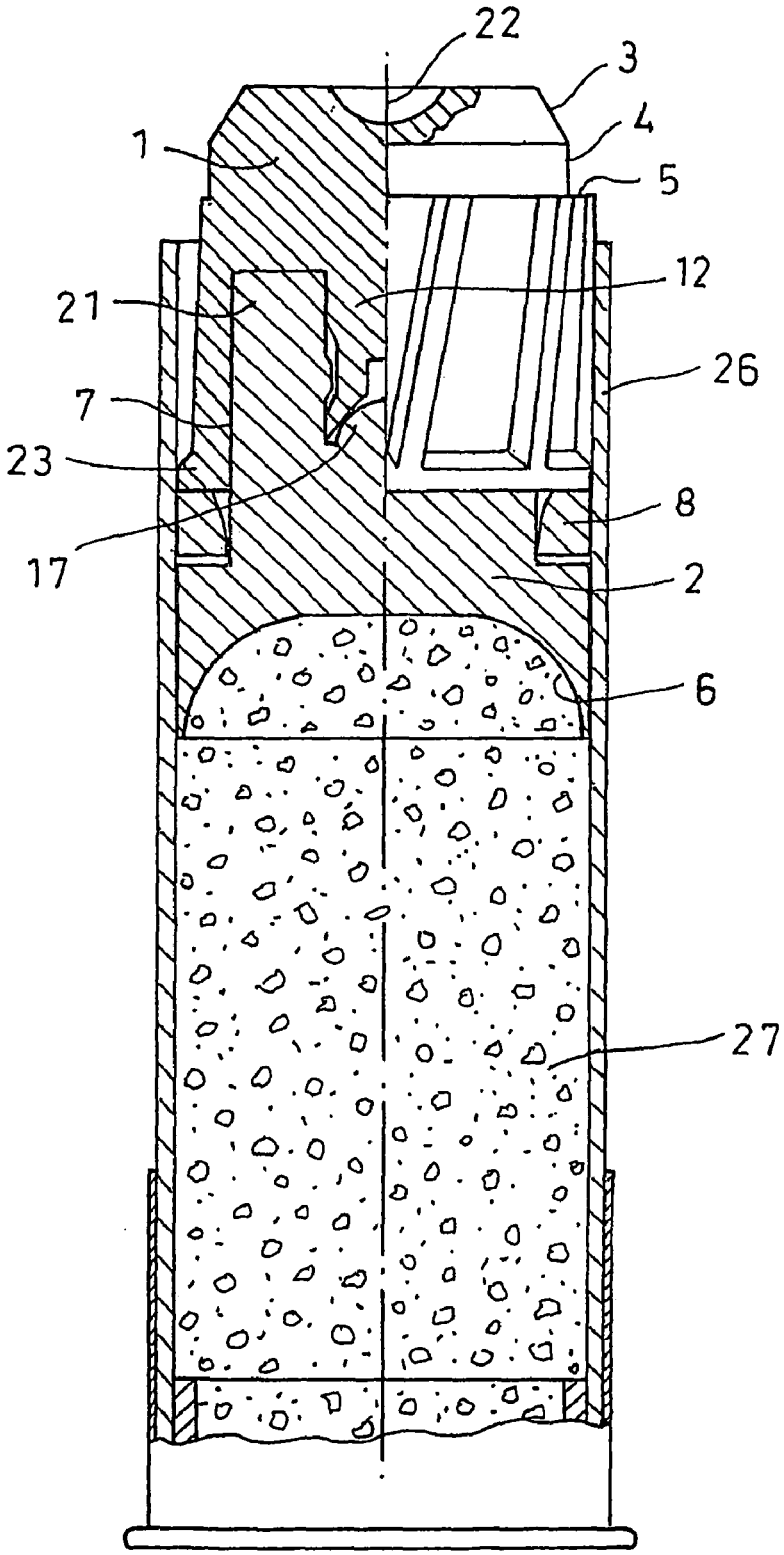
FIG. 3 shows the cartridge 20 after the end of the cartridge case 26 facing in the direction of firing has burst open.

The cartridge 20 shown in FIGS. 1 to 3 will be elucidated in more detail in the following.

Figure 1:
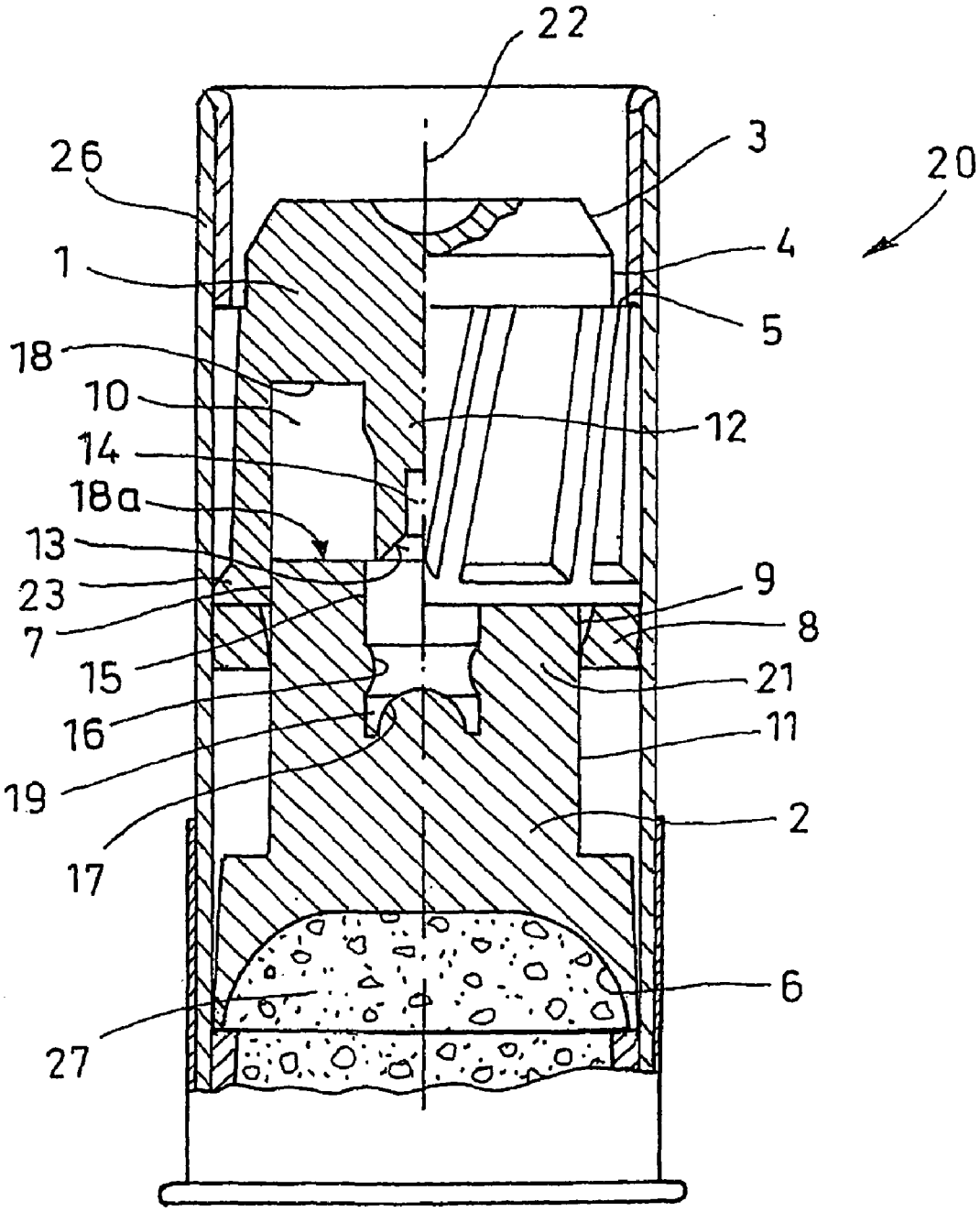
FIG. 1 shows, in a cross-section through a cartridge 20, a shotgun-barrel projectile 1 according to the invention with an intercalation 2 inserted in a cartridge case 26. A propelling charge 27 is arranged below the intercalation 2.

The material of the shotgun-barrel projectile 1 consists of Pb (lead) or of a readily deformable material (see FIG. 1). A bevel 3 with adjoining shoulder 4 has been introduced at the upper end of the projectile 1. In the course of assembly—i.e. doubling-back of the cartridge case 26 inwards by 180° for the purpose of holding the projectile 1 in place—the bevel 3 serves as a guiding aid. The shoulder 4 centres the case 26, and the adjacent plane face 5 extending perpendicular to the axis of symmetry 22 provides for a firm seating of the projectile 1 in the cartridge case 26.

In the course of firing, the shoulder 4 with the plane face 5 consequently has the advantage that the case 26 is held in place until snapping open, and the projectile 1 is thereby centred in the case 26 and also remains centred until leaving the cartridge case 26 (improved hit pattern).

The intercalation 2 consists of plastic, the front part taking the form of a plunger 21, and in the rear part has an obturation aid 6 which prevents a leakage of the propellant charge 27—or, to be more precise, of the gases thereof—in the direction of the projectile 1 after detonation has taken place. In the front region the intercalation 2—or, to be more precise, the plunger 21—has a shoulder 7 which centres the projectile 1 with the intercalation 2. The adjoining large diameter (projectile diameter) of the ring 8, which in this embodiment is connected to the plunger 21 in one piece via an incorporated predetermined breaking-point 9, serves as an assembly stop in the course of mounting the projectile 1 onto the plunger 21 (projectile seating—retracted case). In the course of firing, the predetermined breaking-point 9 provides for a uniform build-up of pressure. After the ring 8 has been sheared off by the pressure of the propelling gases that builds up, the plunger 21 is pushed into the free space 10 of the projectile 1. The sheared-off ring 8 is pressed rearwards in the direction of the obturation aid 6 by the projectile 1 on the centring diameter 11 or on the plunger 21. In this description, the terms "downwards" and "rearwards" are always understood to mean the end opposed to the direction of firing.

When the projectile 1 is telescoped together with the intercalation 2—or, to be more precise, with the plunger 21—a projectile spigot 12 with incorporated bevel 13 and bore 14 is pushed into the bore 15 in the plunger 21 with incorporated diameter reduction 16 and with a hemisphere 17 at the bottom of the bore 15. Once the plunger 21 has travelled a certain distance in the direction of the projectile 1, the bevel 13 comes into contact with the hemisphere 17. From this time until the abutment of the upper side 18*a* of the plunger against the bottom 18 of the free space 10 (initial motion of the projectile), the material of the projectile is pressed into the diameter 19 which becomes larger again. In this way, the desired connection arises, which can no longer be released. The projectile spigot 12 with its bore 14, and the bore 15 with the hemisphere 17 are arranged on the axis of symmetry 22. The diameter of the projectile spigot 12 in the region of the bore 14 is somewhat reduced in comparison with the diameter of the bore 15 in the plunger 21 and corresponds approximately to the diameter created by the diameter reduction 16.

The height of the firm connection between the plunger 21 and the ring 8 determines the gas pressure at which the rupture of the ring 8 takes place. The build-up of pressure in the powder chamber, where the propelling charge 27 is located, determines the rupture of the ring 8 at the predetermined breaking-point 9 and consequently releases the intercalation 2 with the plunger 21. The ring 8 is able to move rearwards on the diameter 11 in a centred manner. The plunger 21 is pushed into the projectile 1, which is held in place by the case 26 which is retracted by 180° at the upper end.

After a certain distance, the bevel 13 impinges on the hemisphere 17 and presses the material located on the bevel 13 into the diameter 19 that becomes larger again. In this way, a firm connection arises between the projectile 1 and the plunger 21. If the two faces 18 and 18*a* abut in a positive manner, the projectile 1 is set in motion contrary to the force of the retracted case 26.

In the process, the case 26 is peeled upwards by the shoulder 4 and by the plane face 5 and additionally centres and stabilises the projectile 1 in the case 26 until said projectile leaves the case 26. This is the prerequisite for a stable flight within and outside the barrel. But only the fully coordinated system guarantees the desired precision.

Advantages of the invention are:

- Centred and stabilised projectile 1 in the case 26 by virtue of the shoulder 4
- A stable intercalation 2 made of plastic
- Uniform build-up of pressure by virtue of the predetermined breaking-point 9 on the ring 8
- Centring of the intercalation 2 and of the projectile 1
- Additional stabilisation by virtue of the sheared-off ring 8
- Firm connection between projectile 1 and intercalation 2—or, to be more precise, plunger 21 (no deflection errors as a result of detachment of the intercalation 2 from the projectile 1).

Figure 4:
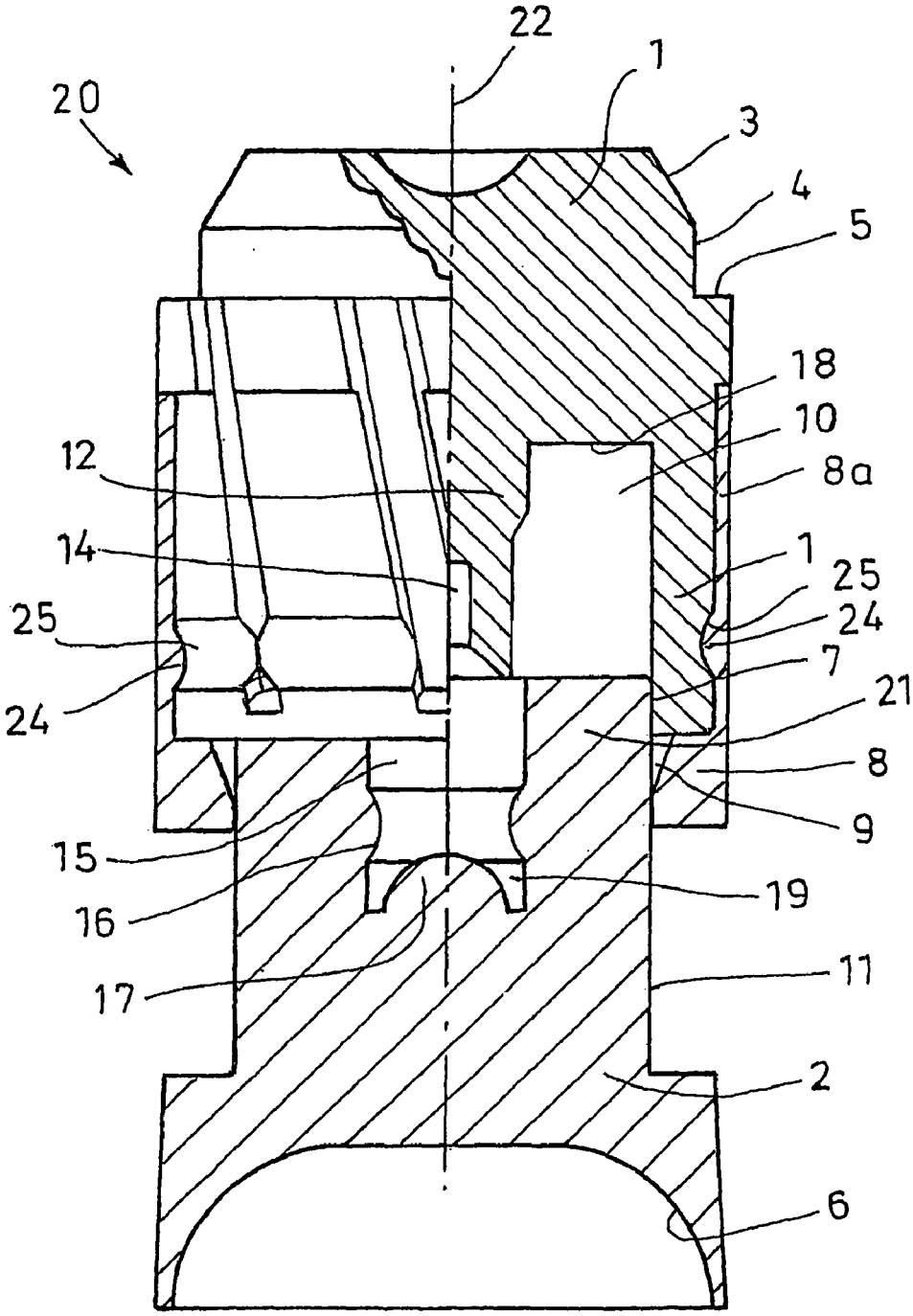
FIG. 4 shows an embodiment in which the ring 8 is L-shaped and with one shank 8*a* encompasses the projectile 1 almost as far as the nose of the projectile.

FIG. 4 shows an embodiment in which the ring 8 is L-shaped and with one shank 8*a* encompasses the projectile 1 almost as far as the nose of the projectile. By virtue of this measure, the abrasion of Pb in the barrel is minimised, since the projectile 1 comes into contact with the barrel only in the upper region.

The invention claimed is:

1. A shotgun-barrel projectile with an intercalation for fitting into a cartridge, the projectile exhibiting a cylindrical free space on its underside, and the intercalation taking the form of a plunger at its end facing towards the projectile, this plunger having a diameter adapted to the free space, characterised in that the projectile is mounted onto the plunger, or conversely, so that before firing the plunger is not wedged in the free space and the plunger is pushed into the free space and wedged in the free space in the course of firing, the free space exhibits a projectile spigot arranged on the axis of symmetry, the plunger exhibits a bore arranged on the axis of symmetry, the projectile spigot and the bore are substantially adapted to one another in diameter, the projectile spigot and the bore are endowed with wedging elements which in the course of firing and insertion of the plunger into the free space bring about a wedging of the plunger and therefore of the intercalation with the projectile, and the wedging elements include a hollow cylindrical design of the end of the projectile spigot facing towards the intercalation, the underside of the projectile spigot exhibiting an inwardly inclined bevel, the bore in the plunger exhibiting a hemisphere arranged at the bottom, and, in addition, a diameter reduction being arranged on the wall of the bore above the hemisphere.

2. A shotgun-barrel projectile with an intercalation for fitting into a cartridge, the projectile exhibiting a cylindrical free space on its underside, and the intercalation taking the form of a plunger at its end facing towards the projectile, this plunger having a diameter adapted to the free space, characterised in that the projectile is mounted onto the plunger, or conversely, so that before firing the plunger is not wedged in the free space and the plunger is pushed into the free space and wedged in the free space in the course of firing, and in that a ring is connected to the plunger on the outer periphery of the plunger via a predetermined breaking-point.

3. The shotgun-barrel projectile according to claim 2, characterised in that the ring is formed in one piece with the plunger.

4. The shotgun-barrel projectile according to claim 2, characterised in that ring constitutes a stop for the projectiles base.

5. The shotgun-barrel projectile according to claim 2, characterised in that the ring is L-shaped and with one shank encompasses the projectile almost as far as the nose of the projectile.

6. The shotgun-barrel projectile according to claim 5, characterised in that the one shank exhibits an inward-facing projection which engages a corresponding recess in the projectile.

7. The shotgun-barrel projectile according to claim 1, characterised in that a nose of the projectile merges via a bevel with an adjoining shoulder running parallel to the axis of symmetry, and the adjoining shoulder running parallel to the axis of symmetry merges with a plane face running perpendicular to the axis of symmetry and extending as far as the outer periphery of the projectile.

8. The shotgun-barrel projectile according to claim 1, characterised in that the intercalation consists of a plastic material and the projectile consists of a readily deformable material.

9. A shotgun-barrel projectile according to claim 8, characterized in that the projectile comprises lead.

10. A cartridge comprising a cartridge case, a propelling charge provided in the cartridge case, and a shotgun-barrel projectile with an intercalation according to claim 1 mounted on the propelling charge.

11. The cartridge according to claim 10, characterised in that a nose of the projectile merges, via a bevel with an adjoining shoulder running parallel to the axis of symmetry, and the adjoining shoulder running parallel to the axis of symmetry merges with a plane face running perpendicular to the axis of symmetry and extending as far as the outer periphery of the projectile, and the upper end of the cartridge case is retracted inwards by 180° and rests on the plane face.

12. The shotgun-barrel projectile according to claim 2, characterised in that a nose of the projectile merges via a bevel with an adjoining shoulder running parallel to the axis of symmetry, and the adjoining shoulder running parallel to the axis of symmetry merges with a plane face running perpendicular to the axis of symmetry and extending as far as the outer periphery of the projectile.

13. The shotgun-barrel projectile according to claim 2, characterised in that the intercalation consists of a plastic material and the projectile consists of a readily deformable material.

14. A shotgun-barrel projectile according to claim 13, characterized in that the projectile comprises lead.

15. A cartridge comprising a cartridge case, a propelling charge provided in the cartridge case, and a shotgun-barrel projectile with an intercalation according to claim 2 mounted on the propelling charge.

16. The cartridge according to claim 15, characterised in that a nose of the projectile merges, via a bevel with an adjoining shoulder running parallel to the axis of symmetry, and the adjoining shoulder running parallel to the axis of symmetry merges with a plane face running perpendicular to the axis of symmetry and extending as far as the outer periphery of the projectile, and the upper end of the cartridge case is retracted inwards by 180° and rests on the plane face.

* * * * *